US005476354A

United States Patent [19]

Crain et al.

[11] Patent Number: 5,476,354

[45] Date of Patent: Dec. 19, 1995

[54] METHOD AND APPARATUS FOR OPENING SOFT-CUP CIGARETTE PACKS

[75] Inventors: Wallace O. Crain; Stephen E. Fischer, both of Louisville, Ky.

[73] Assignee: Brown & Williamson Tobacco Corporation, Louisville, Ky.

[21] Appl. No.: 217,171

[22] Filed: Mar. 23, 1994

[51] Int. Cl.[6] ..... B65B 69/00

[52] U.S. Cl. ..... 414/412; 414/411; 414/786; 414/417; 53/381.2; 83/946; 131/96

[58] Field of Search ..... 414/403, 411, 414/412, 786, 416, 417; 53/381.2; 83/912, 923, 929, 946, 931; 131/96

[56] References Cited

U.S. PATENT DOCUMENTS

| | | | |
|---|---|---|---|
| 3,386,320 | 6/1968 | Pinkham et al. . | |
| 3,863,790 | 2/1975 | Kanarek | 414/412 |
| 4,034,868 | 7/1977 | Rowland, Jr. | 414/411 X |
| 4,988,255 | 1/1991 | Hoffman | 414/412 |
| 5,001,951 | 3/1991 | Eisenlohr et al. | 131/96 X |
| 5,086,790 | 2/1992 | Greene, Jr. | 131/96 |
| 5,117,843 | 6/1992 | Holmes et al. | 131/96 |
| 5,275,523 | 1/1994 | Stewart et al. | 131/96 X |
| 5,304,028 | 4/1994 | Rosenberger et al. | 414/412 |

FOREIGN PATENT DOCUMENTS

| | | | |
|---|---|---|---|
| 360136 | 3/1990 | European Pat. Off. | 414/412 |
| 152642 | 6/1990 | Japan | 414/412 |
| 201830 | 7/1992 | Japan | 414/412 |
| 2105288 | 3/1983 | United Kingdom | 414/412 |

*Primary Examiner*—Frank E. Werner
*Attorney, Agent, or Firm*—Charles I. Sherman

[57] ABSTRACT

An apparatus and method for opening soft-cup packs of cigarettes. In progressive stages, the cellophane wrapper top and the pack closure strip are cut, the cellophane wrapper top piece is removed, the remaining cellophane is removed, the soft-cup is removed, and the foil bundle containing the cigarettes is raked open and the cigarettes removed. Various conveyors move the packs through the stages.

10 Claims, 9 Drawing Sheets

METHOD AND APPARATUS FOR OPENING SOFT-CUP CIGARETTE PACKS

BACKGROUND OF THE INVENTION (a) Field of the Invention

The present invention relates to an apparatus and method for opening soft-cup packs of cigarettes. In progressive stages, the cellophane wrapper top and the pack closure strip are cut, the cellophane wrapper top piece is removed, the remaining cellophane is removed, the soft-cup is removed, and the foil bundle containing the cigarettes is raked open and the cigarettes removed. Various conveyors move the packs through the stages. For example, this apparatus is useful when packs of cigarettes have outlived their shelf-life and the tobacco is to be recovered for other uses.

(b) Description of the Prior Art

The prior art teaches several related methods and apparatuses for removing cigarettes from packs or cartons. For example, U.S. Pat. No. 4,036,380 teaches an apparatus which removes both side walls of a carton of cigarettes and then blows the cigarettes out of the packs. U.S. Pat. No. 4,083,499 teaches a method and apparatus which uses a ripper fan and cyclone separator to reclaim the tobacco from cigarette packs and cartons.

U.S. Pat. No. 5,117,843 teaches removing both end panels from individual cigarette packs and then using a non-intrusive removal force to remove the cigarettes. U.S. Pat. No. 3,386,320 teaches slitting a cigarette package longitudinally along the two opposed sides, then cutting the package transversely to the cigarettes to divide the package into two parts, and then tumbling the parts to remove the cigarettes. Finally, U.S. Pat. No. 5,001,951 teaches an apparatus which cuts individual cigarette packages in half transversely to the cigarettes contained in the packages.

SUMMARY OF THE INVENTION

The present invention is for an apparatus and method for opening soft-cup packs of cigarettes so that the cigarettes can be removed for further processing.

More particularly, the present invention comprises an apparatus for opening packages of cigarettes having means for individually conveying packages of cigarettes, the packs having an outer cellophane wrapper circumscribing a soft-cup pack, the soft-cup pack having a foil wrapper of a plurality of cigarettes therein; the cellophane wrapper having a lap along a side and the soft-cup pack having opposing sides being connected by a closure strip passing across the foil wrapper; means for providing the packages of cigarettes in a proper alignment for opening the packs; means for cutting the closure strip; means for removing the cellophane wrapper; means for removing the soft-cup pack; means for opening the foil wrapper and separating the cigarettes; where the means for individually conveying the packages includes means to feed the packages to the means for cutting the closure strip, the means for removing the cellophane wrapper, the means for removing the soft-cup pack, and the means for opening the foil wrapper and separating the cigarettes.

Finally, the present invention comprises a method for opening soft-cup packs of cigarettes including the steps of cutting through a cellophane wrapper of a soft-cup cigarette pack having a plurality of cigarettes contained therein and cutting a closure strip of the pack; removing and discarding the cellophane wrapper from the pack, leaving the plurality of cigarettes contained in a foil wrapper and partway surrounded by a soft-cup, the foil wrapper having a lap; removing and discarding the soft-cup, leaving the plurality of cigarettes contained in the foil wrapper; and brushing open the foil wrapper at the foil wrapper lap, separating the plurality of cigarettes from the foil wrapper, and discarding the foil wrapper.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
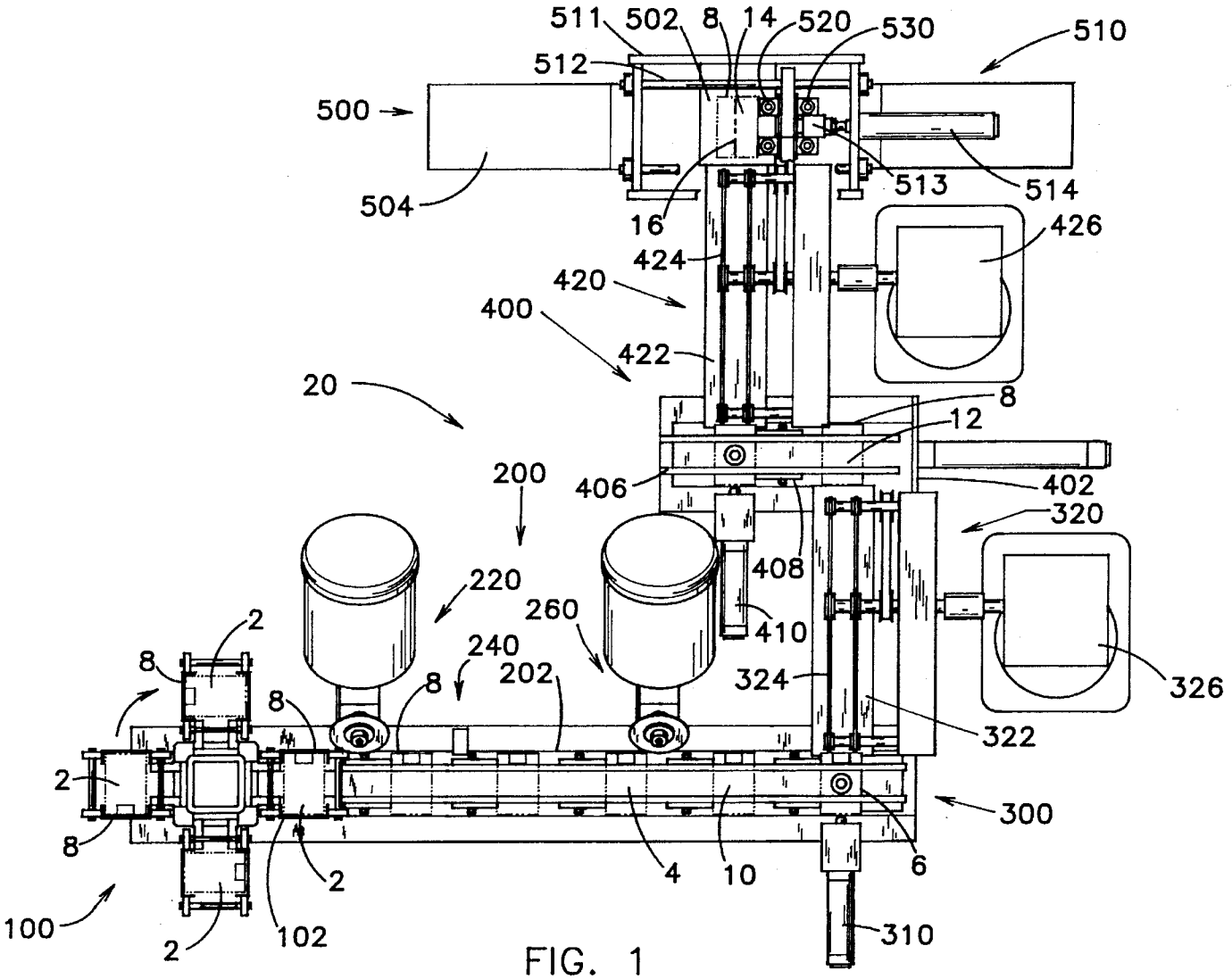
FIG. 1 is a plan view of the soft-cup cigarette pack opening apparatus embodied in the preferred embodiment of the present invention.

For reference, and as identified in the various figures, a cigarette pack 2 is a six-sided rectangular parallelepiped having width ("w"), height ("h"), and thickness ("t"). Normally, twenty standard-sized cigarettes 1 are packed in three rows comprising, in parallel, seven, six, and seven cigarettes, respectively. Therefore, the width, w, of a cigarette pack is approximately the combined diameter of seven cigarettes; the height, h, of a cigarette pack is approximately the length of the cigarette; and, the thickness, t, of a cigarette pack is roughly the combined diameter of three cigarettes. Each pack 2 has a front face side 5 (h×w), a back face side 4 (h×w), a left side 6 (h×t), a right side 7 (h×t), a top 8 (w×t), and a bottom 9 (w×t).

Cigarette packs are usually a soft-cup pack or a more rigid box pack. This invention relates to the soft-cup pack. The current invention is described to function with a pack having the following described pack structure. However, the current invention can be easily modified to function with packs having a different structure.

Preferably, the cigarettes 1 are contained in a six-sided foil wrapper 14 folded at the top and bottom. The foil wrapper 14 overlaps, or has a lap 16 at the back face side 4 of the pack 2. The cigarettes 1 wrapped in foil 14 are received in the paper soft-cup 12. The soft-cup 12 has a front face side 5, a back face side 4, a left side 6, a right side 7, and a bottom 9, but no top. The soft-cup 12 is folded at the bottom 9 and glued. The soft-cup paper overlaps along the pack height and is glued at the overlap which is toward the right edge of the back face side 4. A closure strip 18 is glued at the top center of the front face side 5 of the soft-cup 12, passes across the top of the foil 14, and is glued at the top center of the back face side 4 of the soft-cup 12. The cigarettes 1 contained in the foil wrapper 14 received in the soft-cup 12 having the closure strip 18 thereacross are contained in a six-sided cellophane outer wrapper 10. The cellophane 10 is folded at the top and bottom and heat sealed. The cellophane 10 has a lap extending along the pack height on the pack left side 6, which is also heat sealed.

With reference to FIGS. 1–12, an apparatus 20 of the preferred embodiment is shown which includes a vertical hopper assembly 100, a top cutter and top cellophane removal station 200, a cellophane removal station 300, a soft-cup removal assembly 400, and a foil brush assembly 500. These assemblies/stations function as means to provide packs of cigarettes to be opened, means to cut pack closure strips, means to remove cellophane outer wrappers, means to remove pack soft-cups, and means to open foil wrappers and separate cigarettes therefrom. Various conveyor means move the packs 2 through the pack opening process stages.

Vertical hopper assembly 100 delivers properly oriented cigarette packs 2 to the top cutter and top cellophane removal station 200 via shuttle conveyor 202. At the top cutter and top cellophane removal station 200, the top 8 of each pack 2 is cut by dual cutter assembly 220 toward the pack 2 back face side 4 and toward the pack 2 front face side 5. This cuts through the cellophane 10, the foil wrap 14, and the closure strip 18. After this dual cut, the top 8 of each pack 2 is exposed to the top cellophane removal assembly 240. Next, a single cutter assembly 260 makes a cut at about the top 8 center point, approximately midway between the previously made dual cut and parallel thereto. This single cut will help ensure that the foil wrap 14 can be later opened in case any of the glue on closure strip 18 got onto the foil wrap 14.

Shuttle conveyor 202 provides a pack 2 having three cuts in its top 8 and the top cellophane portion removed to the cellophane removal station 300 for removal of the remaining five sides of the cellophane 10. A plunger assembly 310 pushes on the bottom 9 of pack 2 and a pinch belt conveyor assembly 320 "grabs" the remains of pack 2 toward top 8 and delivers it to the soft-cup removal assembly 400, leaving the remaining cellophane 10 behind for discarding.

Pinch belt conveyor assembly 320 delivers pack 2 having cigarettes 1 with foil wrapper 14 therearound and soft-cup 12 therearound to a mid-shuttle conveyor 402 which positions the pack 2 for removal of the soft-cup 12. Mid-shuttle conveyor 402 and shuttle conveyor 202 function similarly. A plunger assembly 410 pushes on the bottom 9 of pack 2's soft-cup 12 and a pinch belt conveyor assembly 420 "grabs" the remains of pack 2 toward top 8 and delivers it to the foil brush assembly 500, leaving the soft-cup 12 behind for discarding. Plunger assemblies 310 and 410 function similarly and pinch belt conveyors 320 and 420 function similarly.

At foil brush assembly 500, the remains of pack 2, being cigarettes 1 contained only by foil wrapper 14, are positioned for removal. With the foil wrapper 14 lap 16 facing upward, rake assembly 510 is passed over the foil wrapper 14 in a first direction. A detector assembly 540 detects whether or not the foil wrapper 14 was opened. If so, then appropriate cylinder rods 522 or 532 of rake assembly 510 are extended downward and the rake assembly 510 is passed over the now opened foil wrapper 14 in a second direction, the second direction being opposite the first direction, thereby raking the cigarettes 1 from the foil wrapper 14 into a cigarette collection container 504. With foil wrapper 14 opening with one pass of the rake assembly 510, the lap 16 opens toward the pack 2 left side 6. However, the lap 16 can also open toward the pack 2 right side 7. If this is the case, with the first pass of rake assembly 510 over foil wrapper 14 in the first direction, detector assembly 540 shows the foil wrapper 14 was not opened. Therefore, no rods 522 or 532 are extended downward and the rake assembly 510 is passed over the foil wrapper 14 in the second direction. The detector assembly 540 should then detect that the foil wrapper 14 was opened. The appropriate cylinder rods 522 or 532 of rake assembly 510 are extended downward and, for a third time, the rake assembly 510 is passed over the now opened foil wrapper 14 in the first direction thereby raking the cigarettes 1 from the foil wrapper 14 into a cigarette collection container 504. The remaining foil wrapper 14 is discarded and the removed cigarettes 1 can be further processed.

Figure 2:
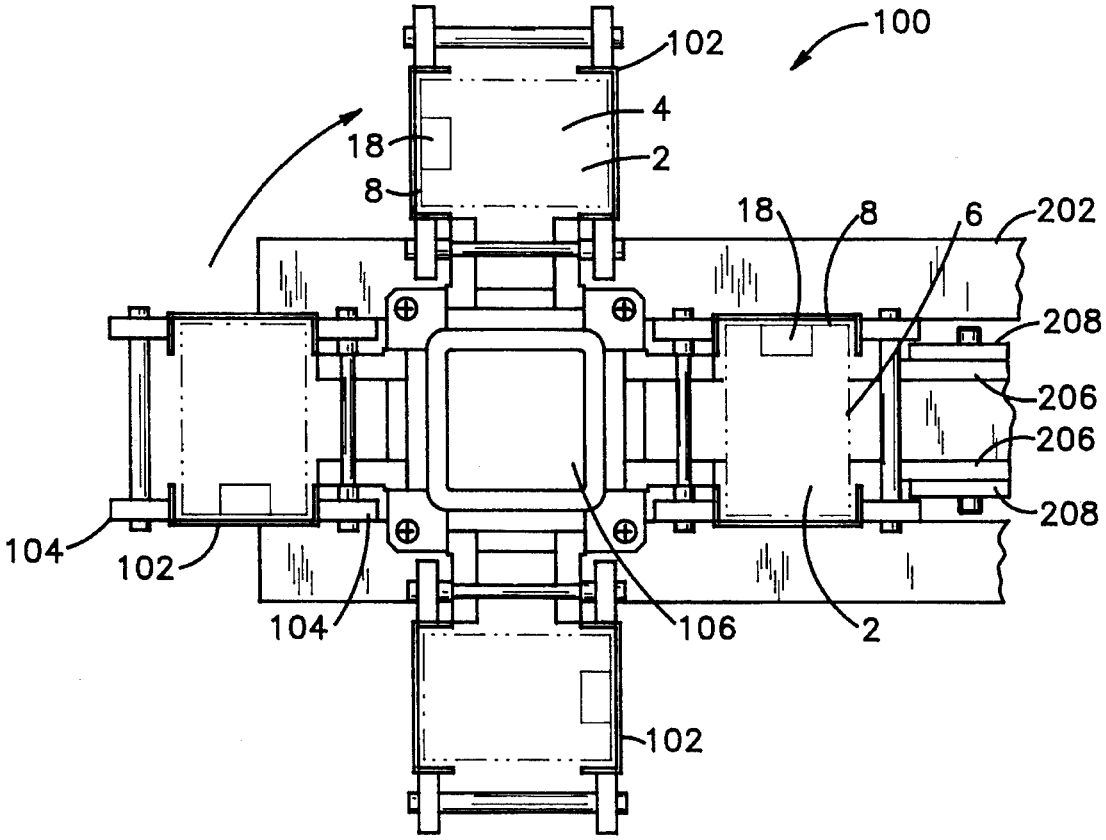
FIG. 2 is a plan view of the vertical cigarette pack hopper assembly of the apparatus of FIG. 1.

FIG. 2 shows the vertical hopper assembly 100 of the apparatus 20 of FIG. 1 in more detail. Vertical hopper assembly 100 functions to place properly oriented individual packs 2 of cigarettes 1 onto a shuttle conveyor 202. As shown, hopper assembly 100 includes a plurality of removable vertical hopper magazines 102. These magazines 102 are, for example, manually filled with cigarette packs 2 for opening. The packs 2 are oriented so that when each pack 2 is placed onto shuttle conveyor 202 the back face side 4 faces in an upward direction and the left side 6 is the leading side moving down the conveyor 202. This alignment properly exposes the top 8 of pack 2 to the cutter assemblies 220 and 260 and top cellophane removal assembly 240 and places the foil wrapper 14 lap 16 facing upward so that after the cellophane wrapper 10 and soft-cup 12 are removed, the foil wrapper 14 can be brushed open. After packs 2 are loaded into magazines 102, they are positioned in housing assembly 104. Hopper assembly 100 also includes rotary support column 106 having rotation means. As shown, four magazines 102 contained in housing 104 are rotated by column 106 in a clockwise direction. Column 106 rotates ninety degrees with each shuttle cycle. Each rotation places a magazine 102 atop shuttle conveyor 202 where a pack 2 is taken by pack conveyor pusher lugs 208 for processing by top cutter and top cellophane removal station 200.

Figure 3:
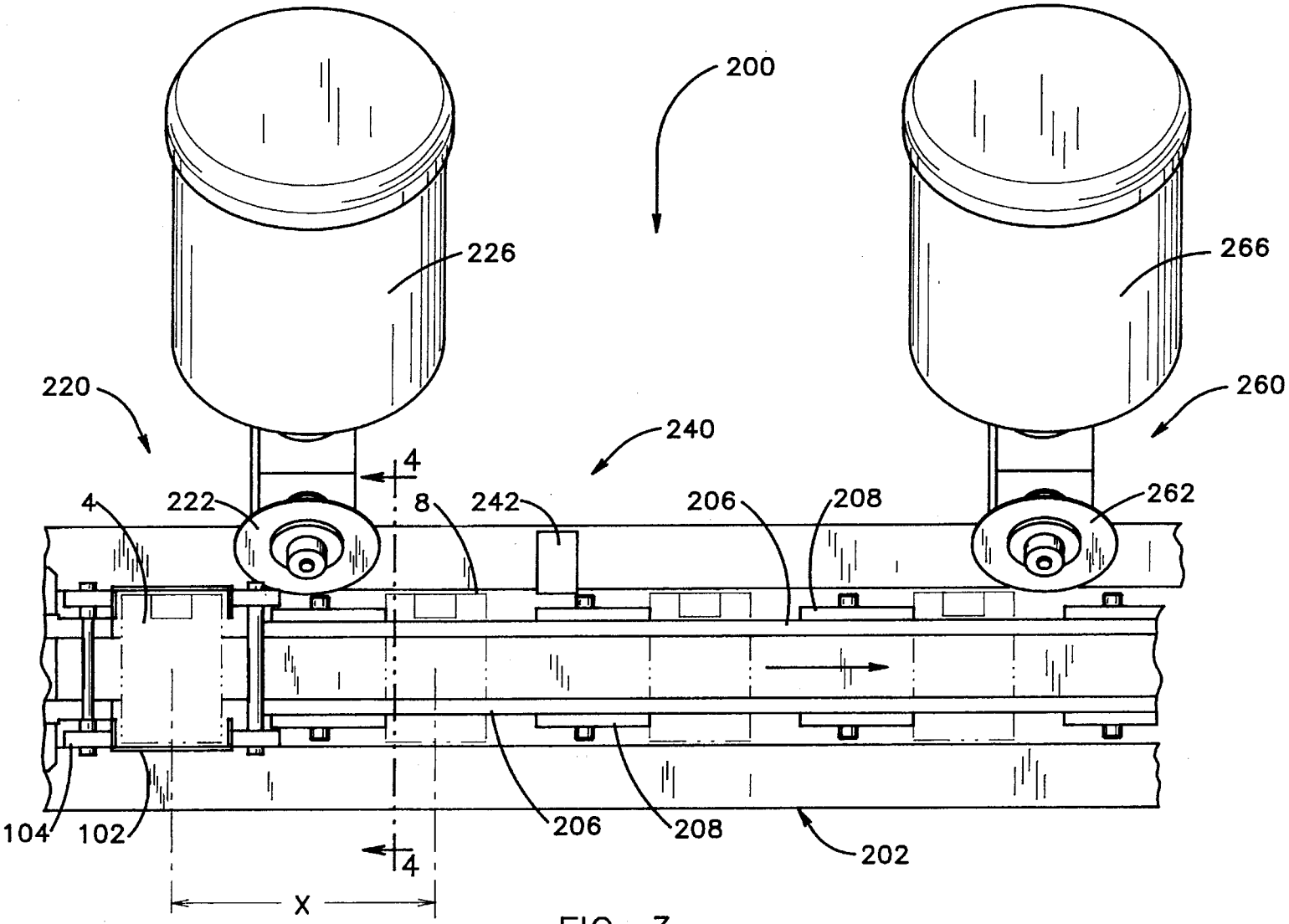
FIG. 3 is a plan view of the closure strip cutter station of the apparatus of FIG. 1.
Figure 4:
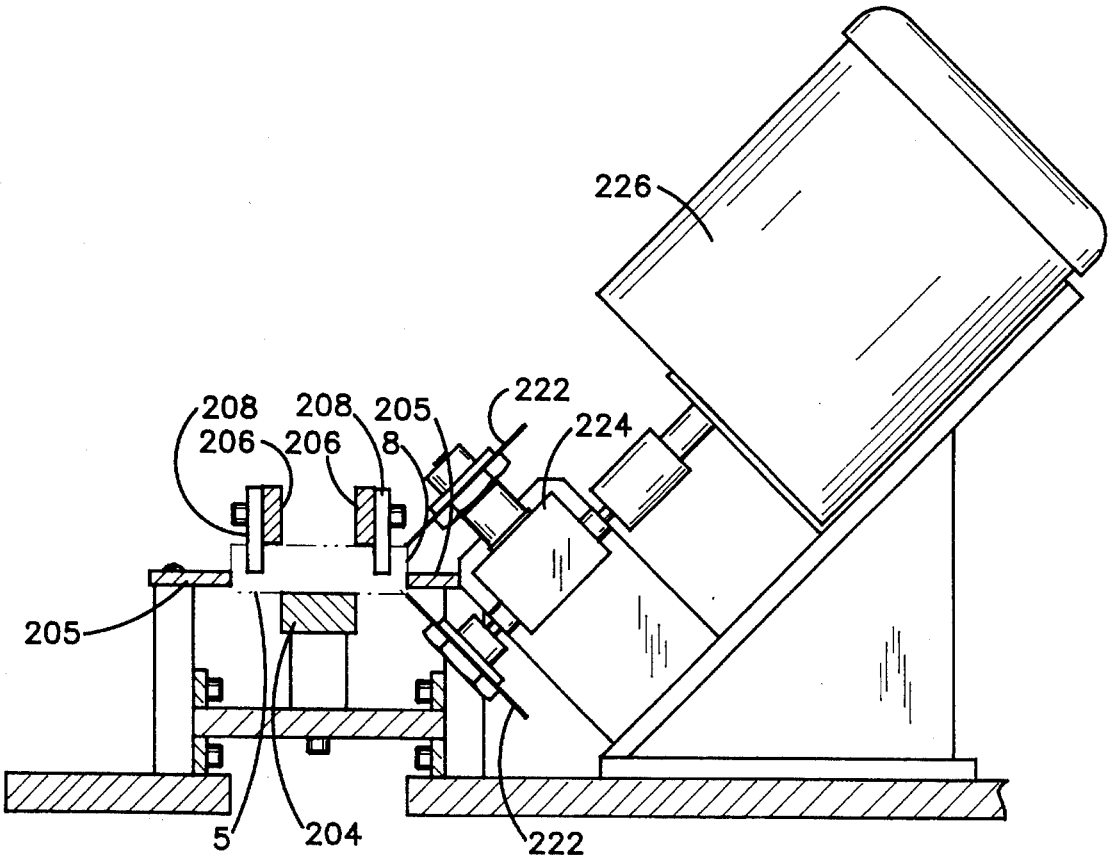
FIG. 4 is an elevational side view of the dual cutter of the closure strip cutter station FIG. 3.

Top cutter and top cellophane removal station 200 is seen in more detail in FIGS. 3 and 4. Top cutter and top cellophane removal station 200 includes, in sequence, a dual cutter assembly 220, a top cellophane removal assembly 240, and a single cutter assembly 260. Shuttle conveyor 202, with each cycle moves packs 2 thereon a cycle distance identified on FIG. 3 by the letter "x". Shuttle conveyor 202 includes a pack support 204, horizontal pack guides 205, pack hold down guides 206 and pack conveyor pusher lugs 208. Pack support 204 supports the pack 2 front face side 5. Horizontal pack guides 205 are located at dual cutter assembly and function to keep the packs 2 being shuttled thereby from twisting while they are having the pack 2 top 8 cut open. Pack hold down guides 206 keep packs 2 being shuttled along conveyor 202 from moving upward away from support 204. Pack conveyor pusher lugs 208 engage pack 2 right side 7 and shuttle packs 2 along conveyor 202.

As seen, in FIGS. 1 and 3, a pack 2 is in hopper magazine 102 positioned atop conveyor 202 ready to be shuttled through dual cutter assembly 220. Five additional packs 2 are preceding this pack along conveyor 202. The closest pack 2 has passed through dual cutter assembly 220 and is ready to be shuttled through top cellophane removal assembly 240. The next closest pack 2 has passed through top cellophane removal assembly 240 and is ready to be shuttled to a position just before single cutter assembly 260. The next closest pack 2 has passed through single cutter assembly 260 and is ready to be shuttled to cellophane removal station 300. The next closest pack is at cellophane removal station 300.

Dual cutter assembly 220 is seen in detail in FIG. 4. Assembly 220 includes a pair of perpendicularly aligned cutting blades 222, a blade drive assembly 224, and a cutter motor 226. As seen, when the top 8 of an unopened soft-cup pack 2 is shuttled past assembly 220, two parallel horizontal cuts are made in the pack 2. These cuts are substantially at the intersections of the top 8 with the back face side 4 and with the front face side 5. These cuts cut through the cellophane outer wrapper 10, through the closure strip 18, and through the foil wrapper 14. Cutting the closure strip 18 at these location frees the soft-cup 12 for later removal.

Top cellophane removal assembly 240 includes a hot heater bar 242. To remove the top portion of the cellophane film wrapper 10 between the two parallel cuts made by dual cutter assembly 220, the top side 8 of pack 2 is raked across the hot heater bar 242.

Single cutter assembly 260 includes a blade 262, a blade drive assembly 264, and a cutter motor 266. Blade 262 makes another horizontal cut in the top 8 of pack 2 approximately half way between the two cuts made by assembly 220. This cut cuts through the closure strip 18 and through the foil wrapper 14 to ensure that the foil wrapper 14 can be later brushed open. This cut is made in case the glue used to glue the closure strip 18 to the front face and back face of the soft-cup 12 has gotten onto the foil wrapper 14.

Figure 5:
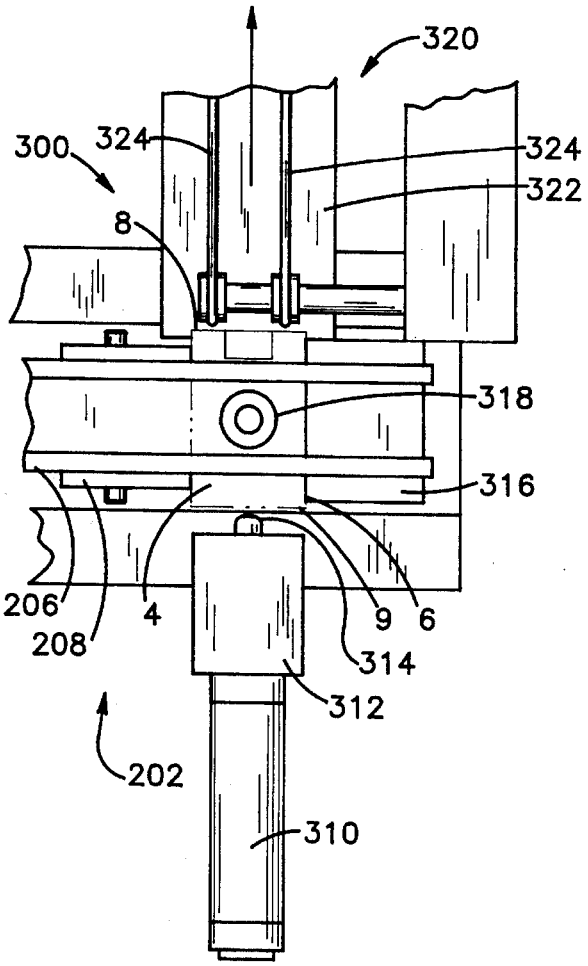
FIG. 5 is a plan view of the cellophane removal station of the apparatus of FIG. 1.
Figure 6:
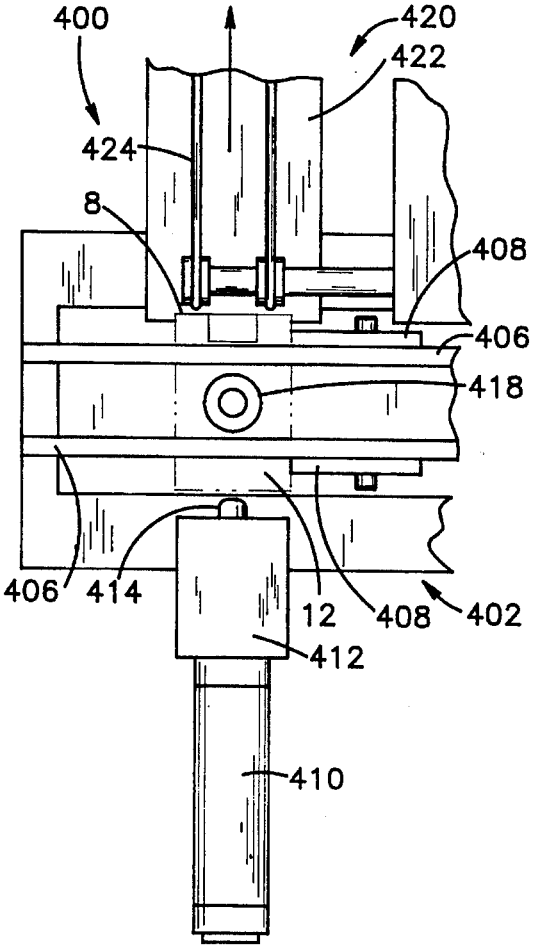
FIG. 6 is a plan view of the outer soft-cup paper wrap removal station of the apparatus of FIG. 1.

The cellophane removal station 300 is shown in FIGS. 1 and 5. Station 300 includes a pneumatic plunger assembly 310 having a housing 312, a projecting pack engaging finger 314, a pack left side heater bar 316, and a vacuum assembly 318. With a pack 2 positioned on conveyor 202 at station 300, the left side 6 of the pack 2 engages the heater bar 316. As was mentioned, for this embodiment, the left side 6 has the cellophane wrapper 10 lap thereon. This contact with the heater bar 316 relieves the heat seat cellophane lap and is particularly necessary if the packs 2 have been tightly wrapped by cellophane wrappers 10. Also, vacuum assembly 318 places a vacuum onto cellophane wrapper 10 at the pack 2 back face side 4 and front face side 5. With the cellophane wrapper 10 lap relieved and with the vacuum applied onto the cellophane wrapper 10, pneumatic plunger assembly 310 causes finger 314 to engage the bottom 9 of pack 2. The vacuum retains the cellophane wrapper 10 while the finger 314 engagement with the pack bottom 9 causes the pack 2 without the cellophane wrapper 10 to move such that a pinch belt conveyor assembly 320 "grabs" the pack 2 toward its top 8. Pinch belt conveyor assembly 320 functions to transport the pack 2 having the cellophane wrapper 10 removed ahead to the soft-cup removal assembly 400 and the remaining cellophane wrapper 10 can be, for example, vacuumed into a waste collection system. Pinch belt conveyor 320 includes a conveyor belt 322 which engages the downward facing front face side 5 of pack 2, pinch belts 324 positioned above conveyor belt 322 and which engages the upward facing back face side 4 of pack 2, and a drive means 326 for simultaneously moving conveyor belt 322 and pinch belts 324.

Pinch belt conveyor 320 delivers the remains of packs 2 to the mid-shuttle conveyor 402 of soft-cup removal assembly 400. Mid-shuttle conveyor 402 functions like shuttle conveyor 202, previously described. Conveyor 402 is shown in FIG. 1 having two packs 2 contained thereon. One pack 2 has been received from pinch belt conveyor 320. The other pack 2 was received previously from pinch belt conveyor 320 and was moved by mid-shuttle conveyor 402 to the location for removing the soft-cup 12. As with shuttle conveyor 202, mid-shuttle conveyor 402 includes pack hold down guides 406 and pack conveyor pusher lugs 408, seen in more detail in FIG. 6.

Soft-cup removal assembly 400 includes a pneumatic plunger assembly 410 and a pinch belt conveyor assembly 420. These function similarly to the respective pneumatic plunger assembly 310 and a pinch belt conveyor assembly 320 of cellophane removal station 300. Pneumatic plunger assembly 410 includes a housing 412, a projecting pack engaging finger 414, and a vacuum assembly 418. Vacuum assembly 418 places a vacuum onto soft-cup 12 at the pack 2 back face side 4 and front face side 5. With the vacuum applied onto the soft-cup 12, pneumatic plunger assembly 410 causes finger 414 to engage the bottom 9 of pack 2. As dual cutter assembly 220 has previously severed the closure strip 18 in two places thereby freeing the soft-cup for removal, the combination of the vacuum retaining the soft-cup 12 while the finger 414 is engaging the pack bottom 9 causes the pack 2 without the soft-cup 12 to move such that a pinch belt conveyor assembly 420 "grabs" the pack 2 toward its top 8. Pinch belt conveyor assembly 420 functions to transport the pack 2 now having both the cellophane wrapper 10 and the soft-cup 12 removed ahead to the foil brush assembly 500 and the remaining soft-cup 12 can be, for example, vacuumed into a waste collection system which may be common or centralized with the system removing the cellophane wrappers 10. Pinch belt conveyor 420 includes a conveyor belt 422 which engages the downward facing front face side 5 of pack 2, pinch belts 424 positioned above conveyor belt 422 and which engages the upward facing back face side 4 of pack 2, and a drive means 426 for simultaneously moving conveyor belt 422 and pinch belts 424.

Figure 7:
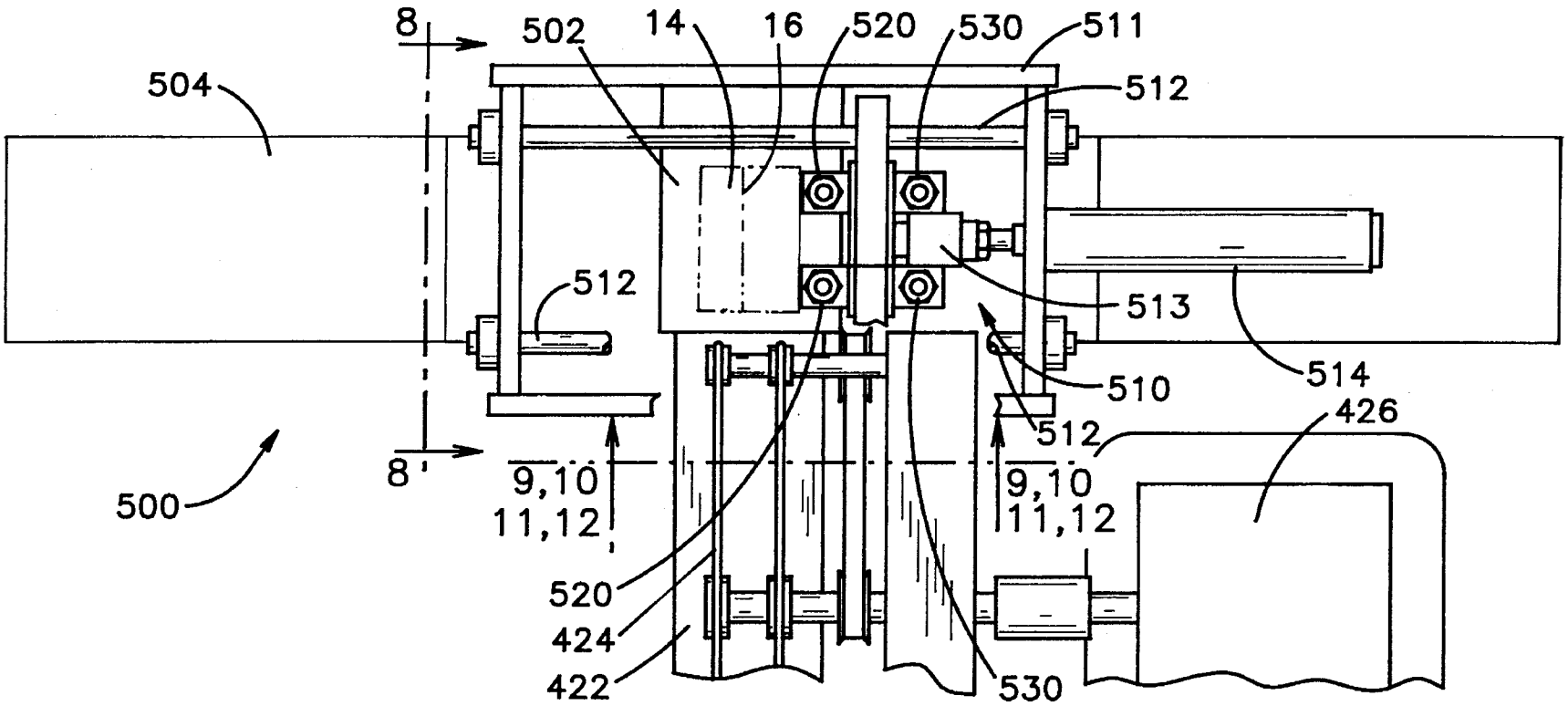
FIG. 7 is a plan view of the cigarette removal station of the apparatus of FIG. 1.

Pinch belt conveyor 420 delivers the remains of packs 2, which now only include the cigarettes 1 contained in foil wrapper 14 having three horizontal parallel cuts in top 8, to a foil pack receiving station 502 of foil brush assembly 500. As is seen in FIGS. 1 and 7, one pack 2 is positioned at station 502 for foil wrapper 14 opening and cigarette removal, the foil wrapper 14 having its lap 16 on pack back face side 4 facing in an upward direction. Again lap 16 runs from pack top 8 to bottom 9 and is parallel to the intersection of back face side 4 with left side 6 or right side 7. Lap 16 may be openable to the left or the right. A rake assembly 510 is shown in its initial position to the right of pack 2 at the pack 2 left side 6. As will be explained hereinafter, the cigarettes 1 are to be separated from the foil wrapper 14 and placed into a removable cigarette container 504 for further processing. The opening operation is best shown in FIGS. 8–12, with continued reference to FIGS. 1 and 7.

A cigarette pack stop cylinder 506 ensures that a pack 2 received from pinch belt conveyor 420 is properly positioned at station 502 for foil wrapper 14 opening and cigarette removal. Vacuum cup assembly 508 exerts a vacuum onto the front face side 5 of foil wrapper 14 to hold wrapper 14 for "brushing" by a rake assembly 510. Rake assembly 510 includes a rake assembly housing 511 supporting a pair of parallel horizontal guide rails 512. Housing 511 retains an extendable carriage cylinder 514 which is attached to rake support 513. Rake support 513 contains a pair of bores 515 which receive guide rails 512 so that rake support 513 is movable along guide rails 512.

Attached to rake support 513 is an assembly having a pair of vertical right hand rake cylinders 520 having a right hand brush 524 therebetween and a pair of vertical left hand rake cylinders 530 having a left hand brush 534 therebetween. If a line was to connect between the pair of vertical right hand rake cylinders 520, that line would be parallel to lap 16. Each cylinder 520 and each cylinder 530 has a cylinder rod 522/532, respectively, therein. These rods 522/532 can be positioned above respective brushes 524/534 or can extend vertically downward to almost engage station 502 for removing the cigarettes 1 from opened foil wrapper 14, as is hereinafter explained.

Brushes 524/534, for example, are approximately two inches wide and can be nylon bristled. As positioned in FIGS. 1, 8, and 9, one brush has its bristles tilted slightly away from pack 2 foil wrapper 14 and the other has its bristles tilted slightly toward pack 2 foil wrapper 14. If the lap 16 is oriented as shown in FIG. 9, opening to the left of the figure, when the brushes 524/534 are passed over pack 2 in a first direction (seen as right to left) across foil wrapper 14, the brush with bristles tilted toward foil wrapper 14 will catch lap 16 and open foil wrapper 14. If the lap 16 opens the other way, to the right of the figure, this pass in the first direction would not open the foil wrapper 14. Therefore, the brushes 524/534 would have to be passed back over the pack 2 in a second direction opposite the first direction (left to right) so that the brush with the bristles now tilted toward foil wrapper 14 will catch lap 16 and open foil wrapper 14. Therefore, one pair of brushes catches the lap 16 if oriented for opening when the brushes 524/534 pass in the first direction and the other pair of brushes catches the lap 16 if oriented for opening when the brushes 524/534 pass in the opposite second direction. This is advantageous as cigarette packaging machines used in the industry are not standardized and foil wrappers 14 can have laps 16 which open to the left or right.

Figure 8:
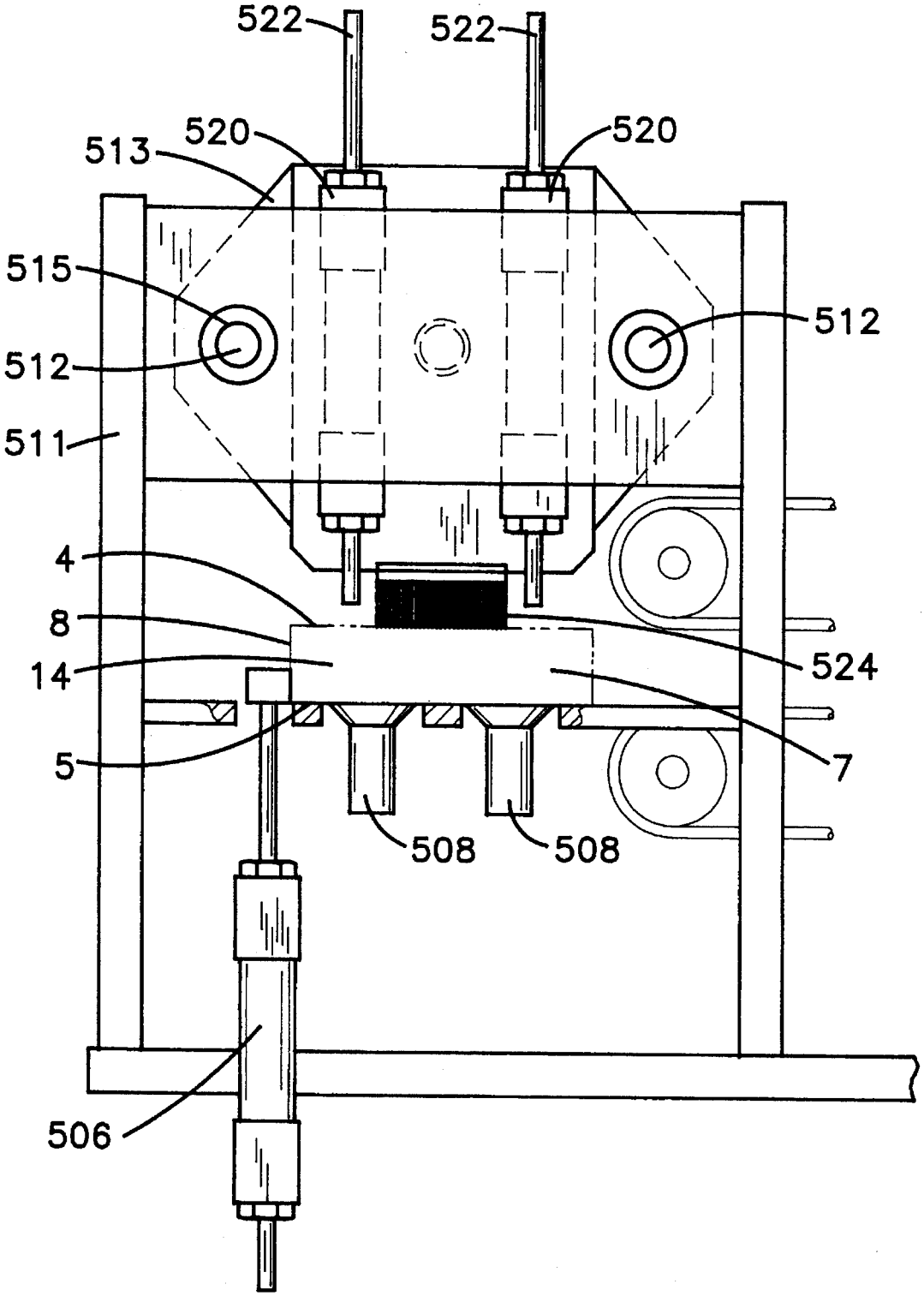
FIG. 8 is an elevational view of the cigarette removal station of the apparatus of FIG. 7.
Figure 9:
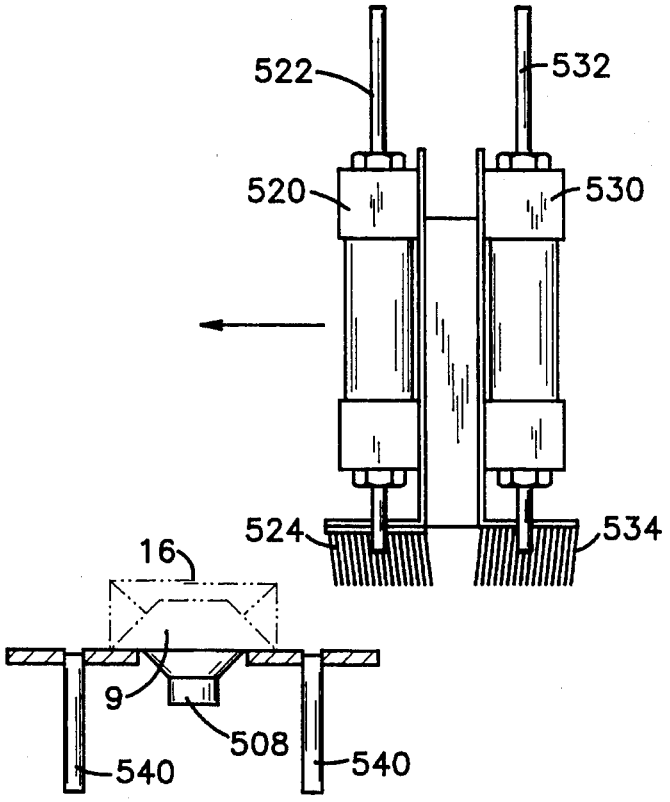
FIG. 9 is a side plan view of the cigarette removal station of the apparatus of FIG. 7 before the cigarettes contained in the foil wrapper have been raked or brushed.
Figure 10:
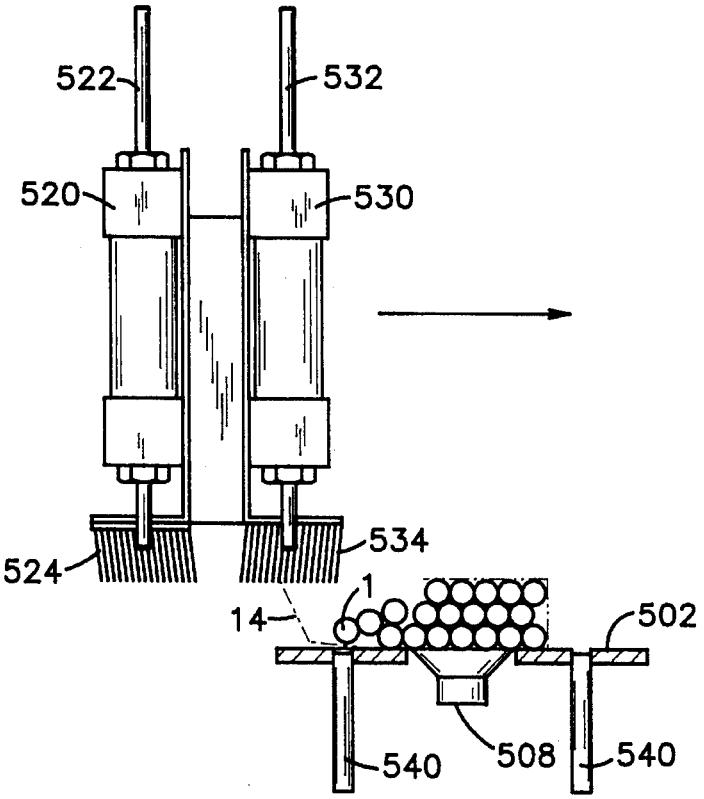
FIG. 10 is a side plan view of the cigarette removal station of the apparatus of FIG. 7 after the cigarettes contained in the foil wrapper have been raked or brushed to open the foil.
Figure 11:
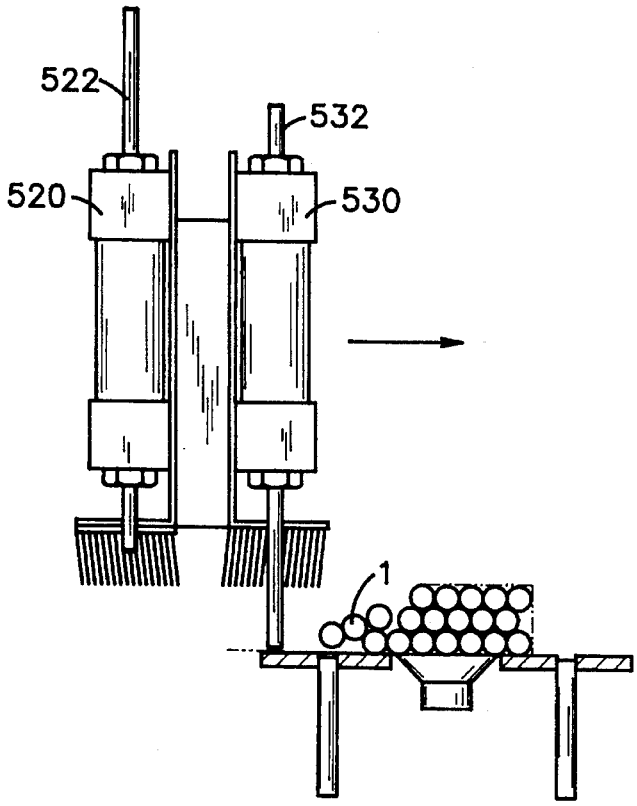
FIG. 11 is a side plan view of the cigarette removal station of the apparatus of FIG. 7 after the cigarettes contained in the foil wrapper have been raked or brushed to open the foil showing the rake cylinder extended to remove the cigarettes; and, FIG. 12 is a side plan view of the cigarette removal station of the apparatus of FIG. 7 showing the cigarettes removed from the foil wrapper.
Figure 12:
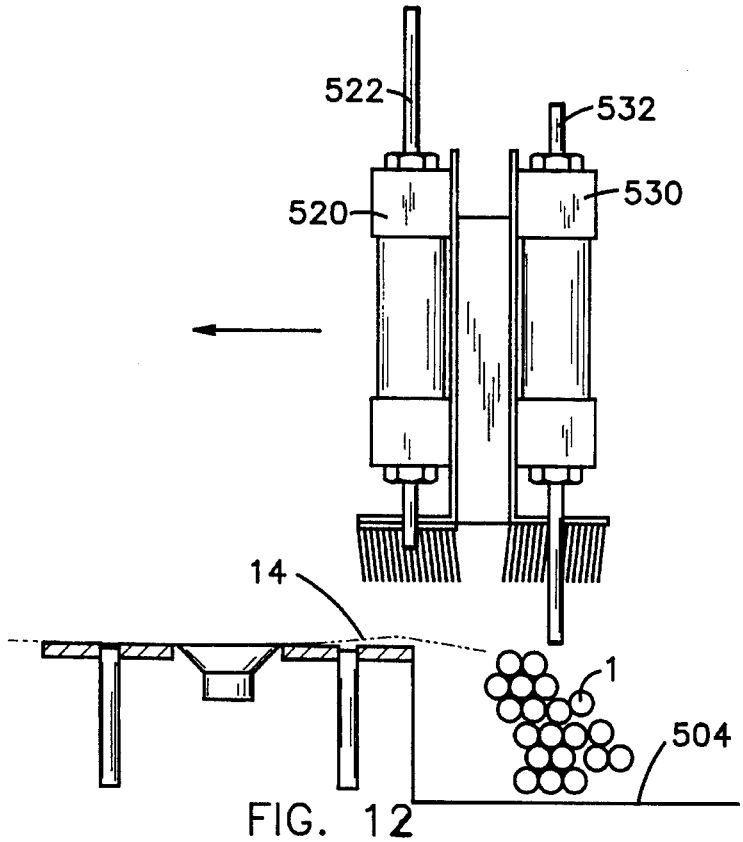

As is seen in FIGS. 8–10, cylinder rods 522/532 are in their uppermost position so as to not interfere with brushes 524/534 when being passed over pack 2. As seen in FIG. 9, pack 2 is oriented for opening with one right to left pass of brushes 524/534 thereacross. In FIG. 10, brushes 524/534 have made this one right to left pass thereacross. As is seen foil wrapper 14 has thereby been opened at lap 16 exposing cigarettes 1. Detectors 540, for example, photoelectric eyes, are provided on station 502 at the left side 6 and the right side 7 of pack 2. These detectors 540 determine whether or not the right to left pass has opened the foil wrapper 14. If no opening is detected with the right to left pass, a left to right pass is made to open the lap 16. In FIG. 10, the opening has been detected, and, as shown in FIG. 11, the cylinder rods 532 have therefore been extended downward. With the rods 532 extending downward, the rake assembly 510 is moved from left to right to separate the cigarettes 1 from opened foil wrapper 14 by pushing them into container 504. The remaining foil wrapper 14 can then be discarded by, for example, vacuuming it into a waste collection system and the downward extending rods 532 are retracted.

If opening and separating cigarettes 1 from foil wrapper 14 involves two passes, the rake assembly 510 is returned to the position shown in FIGS. 1 and 7. If opening and separating cigarettes 1 from foil wrapper 14 involves three passes, the rake assembly 510, instead of being at a position to the right of where the pack 2 was received at station 502, as seen in FIG. 7, would be at a position to the left of where the pack 2 was received at station 502. This means that when the next pack 2 is received at station 502, the first opening pass across the pack 2 will be from left to right. Alternatively, the rake assembly 510 can always be returned to the initial position of FIGS. 1 and 7 before a pack 2 is received by station 502, although this is unnecessary.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. An apparatus for opening packages of cigarettes, comprising:

means for individually conveying packages of cigarettes, said packs having an outer cellophane wrapper circumscribing a soft-cup pack, said soft-cup pack having therein a foil wrapper having a plurality of cigarettes therein;

said cellophane wrapper having a lap along a side of said cellophane wrapper and said soft-cup pack having opposing sides being connected by a closure strip passing across said foil wrapper;

means for providing said packages of cigarettes in a proper alignment for opening said packs;

means for cutting said closure strip;

means for removing said cellophane wrapper;

means for removing said soft-cup pack;

means for opening said foil wrapper and separating said cigarettes;

said means for individually conveying said packages including means to feed said packages to said means for cutting said closure strip, to said means for removing said cellophane wrapper, to said means for removing said soft-cup pack, and to said means for opening said foil wrapper and separating said cigarettes.

2. The apparatus of claim 1, where said cellophane wrapper has a top portion and a non-top portion and where said means for removing said cellophane wrapper includes means for removing said cellophane wrapper top portion and means for removing said cellophane wrapper non-top portion.

3. The apparatus of claim 2, where said cellophane wrapper top portion has a rectangular shape, said top portion having a pair of longer parallel edges; where said cellophane wrapper non-top portion has a bottom, a pair of opposed larger rectangular sides, and a pair of opposed smaller rectangular sides, one of said pair of opposed smaller rectangular sides having said cellophane wrapper lap therealong; where said means for removing said cellophane wrapper top portion includes a pair of blades which cuts said top portion approximately along said pair of longer parallel edges and a heater bar which removes said top portion after said pair of blades have cut said top portion approximately along said pair of longer parallel edges; and, where said means for removing said cellophane wrapper non-top portion includes a heater bar assembly, where said heater bar assembly engages said cellophane wrapper lap, a vacuum assembly, where said vacuum assembly secures said cellophane wrapper non-top portion, and a plunger assembly, where said plunger assembly engages said bottom of said cellophane wrapper non-top portion to cause said soft-cup pack having said foil wrapper having a plurality of cigarettes therein to separate from said cellophane wrapper non-top portion.

4. The apparatus of claim 1, where said means to feed said packages feeds said packages sequentially to said means for removing said cellophane wrapper top portion to said means for cutting said closure strip, to said means for removing said cellophane wrapper non-top portion, to said means for removing said soft-cup pack, and to said means for opening said foil wrapper and separating said cigarettes.

5. The apparatus of claim 1, where said means for individually conveying the packages of cigarettes includes a first stepped shuttle conveyor assembly, a first pinch belt conveyor assembly, a second stepped shuttle conveyor assembly, and a second pinch belt conveyor assembly; where said first stepped shuttle conveyor assembly receives said packs from said means for providing said packages of cigarettes in a proper alignment for opening said packs and conveys said packs to said first pinch belt conveyor assembly; where said first pinch belt conveyor assembly conveys said packs to said second stepped shuttle conveyor assembly; where said second stepped shuttle conveyor assembly conveys said packs to said second stepped shuttle conveyor assembly; and, where said second stepped shuttle conveyor assembly conveys said packs to a cigarette removal station assembly.

6. The apparatus of claim 5, where said means for cutting said closure strip cuts said closure strip and where said means for removing said cellophane wrapper removes said cellophane wrapper while said first stepped shuttle conveyor assembly conveys said packs from said means for providing said packages of cigarettes in a proper alignment for opening said packs to said first pinch belt conveyor assembly; and, where said means for removing said soft-cup pack removes said soft-cup pack while said second stepped shuttle conveyor assembly conveys said packs from said first pinch belt conveyor assembly to said second pinch belt conveyor assembly.

7. The apparatus of claim 1, where said means for cutting said closure strip includes a blade aligned in a transverse relationship with said closure strip passing across said foil wrapper.

8. The apparatus of claim 1, where said soft-cup pack has a bottom and where said means for removing said soft-cup pack includes a vacuum assembly and a plunger assembly, where said vacuum assembly secures said soft-cup pack, and, where said plunger assembly engages said bottom of said soft-cup pack to cause said foil wrapper having a plurality of cigarettes therein to separate from said soft-cup pack.

9. The apparatus of claim 1, where said means for opening said foil wrapper and separating said cigarettes further comprises:

a. a vacuum cup assembly securing said foil wrapper having said plurality of cigarettes therein at a foil pack receiving station;

b. a rake assembly, said rake assembly including a right hand rake and a left hand rake, said right hand rake having a right hand cylinder rod and said left hand rake having a left hand cylinder rod, said cylinder rods having an upward position and a downward position; and, c. a detector to determine if said foil wrapper has been opened;

where, with said cylinder rods in their upward positions, said rake assembly is moved in a first direction over said foil wrapper having said plurality of cigarettes therein, said rakes engaging said foil wrapper, said detector detecting if said foil wrapper has been initially opened;

where, if said foil wrapper has been initially opened, with said cylinder rods in their upward positions, said rake assembly is moved in a second direction over said foil wrapper having said plurality of cigarettes therein, said second direction being opposite said first direction, said rakes engaging said foil wrapper, said detector further detecting if said foil wrapper has been opened completely; where, with at least one of said cylinder rods in a downward position, said rake assembly is moved in said first direction over said completely opened foil wrapper thereby separating said cigarettes from said foil wrapper;

where, if said foil wrapper has not been initially opened when moving said rake assembly in a first direction, with said cylinder rods in their upward positions, said rake assembly is moved in a second direction over said foil wrapper having said plurality of cigarettes therein, said second direction being opposite said first direction, said rakes engaging said foil wrapper, said detector detecting if said foil wrapper has been initially opened; where, if said foil wrapper has been initially opened, with said cylinder rods in their upward positions, said rake assembly is moved in said first direction over said foil wrapper having said plurality of cigarettes therein, said rakes engaging said foil wrapper, said detector further detecting if said foil wrapper has been opened completely; where, with at least one of said cylinder rods in a downward position, said rake assembly is moved in said second direction over said completely opened foil wrapper thereby separating said cigarettes from said foil wrapper.

10. A method for opening soft-cup cigarette packs, comprising the steps of:

a. cutting through a cellophane wrapper of a soft-cup cigarette pack having a plurality of cigarettes contained therein and cutting a closure strip of said pack;

b. removing and discarding said cellophane wrapper from said pack, leaving said plurality of cigarettes contained in a foil wrapper and partway surrounded by a soft-cup, said foil wrapper having a lap;

c. removing and discarding said soft-cup, leaving said plurality of cigarettes contained in said foil wrapper; and d. brushing open said foil wrapper at said foil wrapper lap, separating said plurality of cigarettes from said foil wrapper, and discarding said foil wrapper.

* * * * *